US010201985B2

(12) United States Patent
Jang et al.

(10) Patent No.: US 10,201,985 B2
(45) Date of Patent: Feb. 12, 2019

(54) DRYER FOR INKJET IMAGE FORMING APPARATUS AND IMAGE FORMING SYSTEM HAVING THE SAME

(71) Applicant: S-PRINTING SOLUTION CO., LTD., Suwon-si, Gyeonggi-do (KR)

(72) Inventors: Kyung Hwan Jang, Hwaseong-si (KR); Hae Seog Jo, Yongin-si (KR); Tae Hong Kim, Yongin-si (KR); Tae Jin Baek, Suwon-si (KR); Joon Sik An, Bucheon-si (KR)

(73) Assignee: HP PRINTING KOREA CO., LTD., Suwon-si (KR)

( * ) Notice: Subject to any disclaimer, the term of this patent is extended or adjusted under 35 U.S.C. 154(b) by 0 days.

(21) Appl. No.: 15/238,296

(22) Filed: Aug. 16, 2016

(65) Prior Publication Data

US 2017/0050448 A1 Feb. 23, 2017

Related U.S. Application Data

(60) Provisional application No. 62/206,579, filed on Aug. 18, 2015.

(30) Foreign Application Priority Data

Nov. 3, 2015 (KR) ..... 10-2015-0153996

(51) Int. Cl.
*B41J 11/00* (2006.01)
*B41J 2/01* (2006.01)

(52) U.S. Cl.
CPC ..... *B41J 11/002* (2013.01); *B41J 2/01* (2013.01)

(58) Field of Classification Search
CPC ..... B41J 11/002
See application file for complete search history.

(56) References Cited

U.S. PATENT DOCUMENTS 6,120,199 A * 9/2000 Takekoshi ..... B41J 11/0005 347/102
6,130,408 A * 10/2000 Fukuda ..... G03G 15/2007 219/216
7,201,478 B2 * 4/2007 Kasai ..... C09D 11/322 347/100
2003/0164958 A1 * 9/2003 Shima ..... B41J 11/002 358/1.7
2003/0169322 A1 * 9/2003 Shima ..... B41J 11/0005 347/102
2003/0184630 A1 * 10/2003 Elgee ..... B41J 11/002 347/102
2008/0117273 A1 * 5/2008 Yamashita ..... B41J 2/17509 347/96

(Continued)

FOREIGN PATENT DOCUMENTS

JP 2013-29268 2/2013

*Primary Examiner* — Sharon A Polk
(74) *Attorney, Agent, or Firm* — Staas & Halsey LLP

(57) ABSTRACT

Disclosed herein are a dryer for an inkjet image forming apparatus and an imaging forming system having the same. The dryer for an inkjet image forming apparatus includes a heating device detachably installed in the inkjet image forming apparatus to dry a print medium in which a printing is completed by receiving the print medium from the inkjet image forming apparatus. An ink on the print medium may be dried in a short time and an image formation may be more quickly performed.

17 Claims, 8 Drawing Sheets

(56) References Cited

U.S. PATENT DOCUMENTS

| | | | | |
|---|---|---|---|---|
| 2009/0256896 | A1* | 10/2009 | Scarlata | B41J 11/0005 347/101 |
| 2010/0028036 | A1* | 2/2010 | Aratachi | G03G 15/2039 399/69 |
| 2010/0201755 | A1* | 8/2010 | Mita | B41J 2/14233 347/71 |
| 2011/0228025 | A1* | 9/2011 | Miyamoto | B41J 11/002 347/102 |
| 2013/0057629 | A1* | 3/2013 | Miyamoto | B41J 11/0005 347/104 |

* cited by examiner

DRYER FOR INKJET IMAGE FORMING APPARATUS AND IMAGE FORMING SYSTEM HAVING THE SAME

CROSS-REFERENCE TO RELATED APPLICATIONS

This application claims the benefit of Korean Patent Application No. 10-2015-0153996, filed on Nov. 3, 2015 in the Korean Intellectual Property Office, and U.S. Provisional Application No. 62/206,579, filed on Aug. 18, 2015, the disclosure of which is incorporated herein by reference.

BACKGROUND

1. Field

Embodiments of the present disclosure relate to a dryer for an inkjet image forming apparatus configured to dry a print medium on which image formation is completed by an inkjet image forming apparatus, and an imaging forming system having the same.

2. Description of the Related Art

An image forming apparatus is configured to form an image on a print medium, and includes an inkjet image forming apparatus that is configured to form an image by directly spraying a liquid type ink on a print medium.

Since the inkjet image forming apparatus is configured to form an image by directly spraying a liquid type ink on a print medium, when a piece of paper is used as a print medium, it may be needed a process in which the print medium is wet by the ink and then dried during a process of forming an image by using the ink.

In the case of a print medium forming of a piece of paper, since it requires a period of time to dry an ink, it may be difficult to form an image quickly and the print medium may be partially deformed during the print medium is wet and then dried. Therefore, there may be a difficulty of a post-processing by a post-processor.

SUMMARY

Therefore, it is an aspect of the present disclosure to provide to a dryer for an inkjet image forming apparatus configured to more rapidly dry an ink on a print medium discharged from an inkjet image forming apparatus, and an imaging forming system having the same.

Additional aspects of the disclosure will be set forth in part in the description which follows and, in part, will be obvious from the description, or may be learned by practice of the disclosure.

In accordance with one aspect of the present disclosure, a dryer for an inkjet image forming apparatus includes a heating device detachably installed in an inkjet image forming apparatus to dry a print medium in which a printing is completed, after receiving the print medium from the inkjet image forming apparatus.

The heating device may include a lamp configured to irradiate a light to a surface of the print medium.

The heating device may include a heater configured to generate a heat.

The heating device may include a blowing fan configured to blow air to a surface of the print medium.

The dryer may further include a flattening device configured to flatten evenly a surface of the print medium that is dried by the heating device.

The flattening device may include a heating roller configured to apply a heat to the print medium and a pressure roller configured to press the print medium via the heating roller.

The flattening device may include a heating belt provided with a heater disposed inside of the heating belt; a pressure roller configured to press the print medium toward an outer surface of the heating belt; a reflector disposed inside of the heating belt, particularly between the heater and the pressure roller; and a guide member disposed opposite to the pressure roller in a state in which the heating belt is interposed.

The dryer may further include a decurling device configured to curl the print medium in a direction opposite to a direction of a curl of the print medium that occurs in a process of passing through the flattening device.

The decurling device may include a main roller and a pair of auxiliary roller having a diameter smaller than that of the main roller and disposed in contact side by side with an outer circumference surface of the main roller.

The decurling device may include a shaft having a stick shape, and an elastic roller having an outer circumference formed of elastically deformable material to press the print medium toward an outer circumference of the shaft.

The dryer may further include a humidifier configured to supply moisture to a second surface, which is disposed opposite to a first surface, of the print medium after receiving the print medium in which an image is formed on only the first surface thereof via the inkjet image forming apparatus.

The humidifier may include a water bucket in which water is stored, and an ultrasonic vibrator installed in a lower surface of the water bucket.

The ultrasonic vibrator may include a vibration plate disposed such that an upper surface thereof makes contact with water inside of the water bucket, and a piezoelectric element disposed on a lower surface of the vibration plate to allow the vibration plate to be vibrated.

The vibration plate may include micro holes having a diameter allowing atomized water to be passed through, and the piezoelectric element may include a penetration hole disposed in a position corresponding to the micro holes.

The humidifier may include a nozzle configured to spray water to the second surface of the print medium.

In accordance with one aspect of the present disclosure, an image forming system includes an inkjet image forming apparatus; a post-processor configured to perform post-processing a print medium delivered from the inkjet image forming apparatus; and a dryer disposed between the inkjet image forming apparatus and the post-processor to dry the print medium delivered from the inkjet image forming apparatus to transmit the dried print medium to the post-processor.

The dryer may be detachably installed between the inkjet image forming apparatus and the post-processor.

The inkjet image forming apparatus may include the dryer.

The post-processor may include the dryer.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
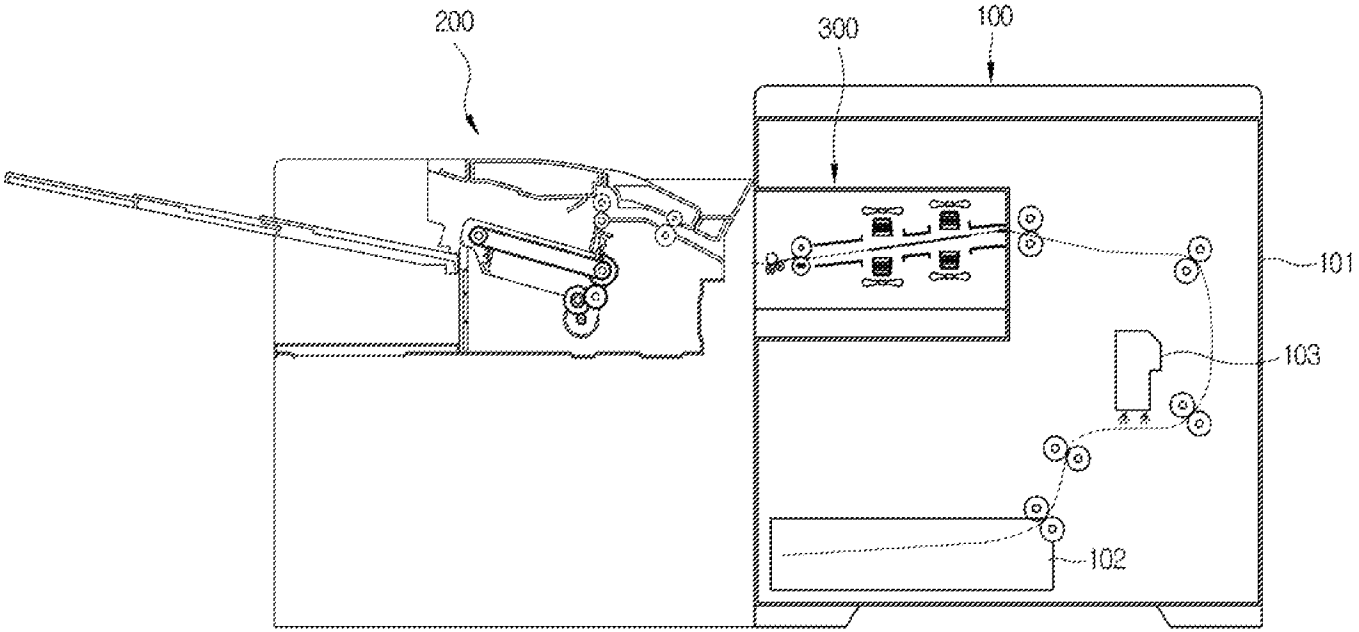
FIG. 1 is a schematic view of an image forming system in accordance with a first embodiment of the present disclosure.

Reference will now be made in detail to the embodiments of the present disclosure, examples of which are illustrated in the accompanying drawings, wherein like reference numerals refer to like elements throughout.

As illustrated in FIG. 1, according to a first embodiment, an image forming system may include an inkjet image forming apparatus 100 configured to form an image by spraying an ink to a print medium, e.g. a piece of paper, a post-processor 200, after receiving a print medium in which an image forming is completed by the inkjet image forming apparatus 100, configured to perform post-processing the print medium, and a dryer 300 disposed between the inkjet image forming apparatus 100 and the post-processor 200 to dry an ink on the print medium.

Print media discharged from the inkjet image forming apparatus 100 may be dried in a process of passing through the dryer 300 and then delivered to the post-processor 200.

According to the first embodiment, the dryer 300 may be detachably installed between the inkjet image forming apparatus 100 and the post-processor 200, and thus the dryer 300 may be installed between the inkjet image forming apparatus 100 and the post-processor 200 to be used when the dryer 300 is needed to be used.

The inkjet image forming apparatus 100 may include a housing 101 forming an exterior of the inkjet image forming apparatus 100, a print medium cartridge 102 movably installed in a lower side of the housing 101 to store a print medium, e.g. a piece of paper, inside thereof, and an ink cartridge 103 detachably installed in the housing 101 and configured to form an image by spraying an ink to a print medium supplied from the print medium cartridge 102.

The post-processor 200 may be configured to perform post-processing on a print medium after receiving the print medium from the inkjet image forming apparatus 100 and then loading the print medium and in addition, the post-processor 200 may perform an operation such as arranging loaded print medium and stapling the print medium. Although not shown in the drawings, a post-processor configured to perform binding a print medium may be used.

Figure 2:
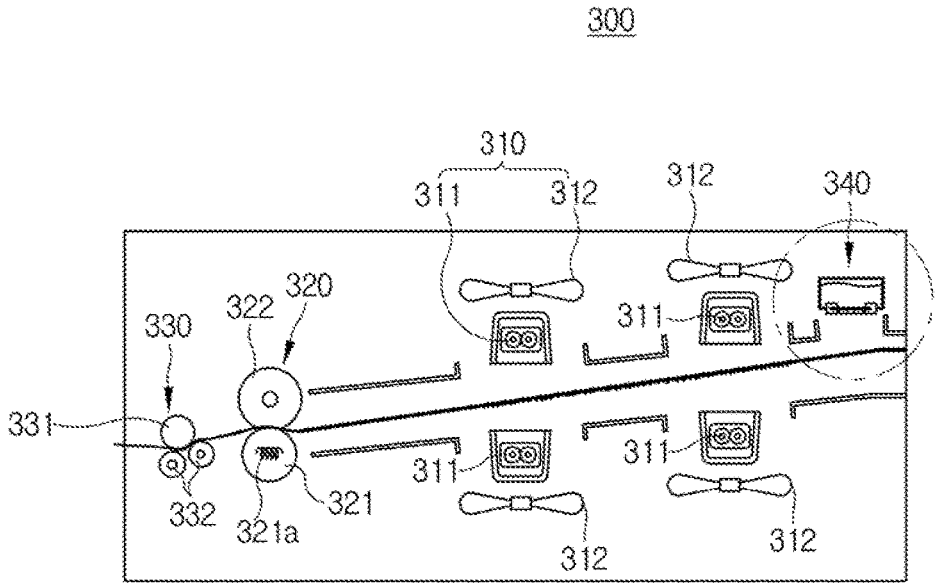
FIG. 2 is a schematic view of a dryer for an inkjet image forming apparatus applied to an image forming system in accordance with a first embodiment of the present disclosure.

The dryer 300 may include a heating device 310 to dry an ink on a print medium, as illustrated in FIG. 2.

According to the first embodiment, the heating device 310 may include a lamp 311 configured to irradiate a light to an ink on a print medium and a blowing fan 312 configured to dry an ink on a print medium via a wind by discharging an air to an surface of the print medium.

According to the first embodiment, four lamps 311 may be provided and four blowing fans 312 may be provided so that opposite surfaces of a print medium are dried by two lamps 311 and four blowing fans 312, respectively.

Therefore, when an image is formed on a first surface of a print medium (a lower surface of the print medium with reference to FIG. 2), the lamps 311 and the blowing fans 312 corresponding to the first surface may be operated or the lamps 311 corresponding to a second surface of the print medium (an upper surface of the print medium with reference to FIG. 2) that is opposite to the first surface may be operated at a low temperature and the blowing fans 312 corresponding to the second surface may be operated at a low speed so that an energy consumption may be minimized while a drying speed is constantly maintained.

When an image is formed on both of the first surface and the second surface of the print medium that is opposite to the first surface, the all of lamps 311 and the all of blowing fans 312 may be operated so that the ink is quickly dried.

As mentioned above, drying ink on the print medium may be quickly performed by the dryer 300, and thus forming an image may be more quickly processed.

As mentioned above, the print medium may be wet by an ink sprayed from the ink cartridge 103 and then dried by the heating device 310, and a surface of the print medium may be unevenly deformed during this process. Accordingly, when the print medium is loaded, a height of the print medium may be increased due to a deformed surface of the print medium. Therefore, when the print medium having the deformed surface is loaded in the post-processor 200, the relatively less number of the print medium may be arranged and stapled then the number of originally arranged and stapled print medium by the post-processor 200.

The dryer 300 applied to the image forming system according to the present disclosure may include a flattening device 320 configured to flatten an unevenly deformed surface of a print medium.

According to the first embodiment, the flattening device 320 may include a heating roller 321 configured to apply a heat to a print medium and a pressure roller 322 disposed opposite to the heating roller 321. The heating roller 321 may include a heater **321*a* configured to generate a heat inside thereof, and an outer surface of the pressure roller 322 may be formed of elastically deformable material, thereby pressing the print medium via the pressure roller 322**.

Therefore, the unevenly deformed surface of the print medium may be evenly flattened by passing between the heating roller 321 and the pressure roller 322 and thus a thickness of the print medium may be practically same as that of an original print medium. Accordingly, a difficulty, which may occur when a deformed print medium is loaded in the post-processor 200, may be prevented.

As mentioned above, during the print medium passes between the heating roller 321 and the pressure roller 322, a curl having a shape corresponding to an outer circumferential surface of the heating roller 321 may be inevitably generated on the print medium. When the curl is generated in the print medium, there may be a difficulty in loading the print medium in the post-processor 200.

The dryer 300 may include a decurling device 330 configured to perform decurling on the print medium by curling the print medium in an opposite direction to a curling that is generated in the print medium by the flattening device 320.

According to the first embodiment, the decurling device 330 may include a main roller 331 and a pair of auxiliary roller 332 having a diameter relatively smaller than that of the main roller 331 and disposed in contact side by side with an outer circumference surface of the main roller 331. Therefore, during the print medium passes between the main roller 331 and the two auxiliary rollers 332, a curling may be generated in a direction opposite to a direction of a curling generated by the flattening device 320 so that the print medium may be decurled.

A curl generated in a direction on the print medium by the flattening device 320 and a curl generated in a direction, which is opposite to the direction of the curl by the flattening device 320, by the decurling device 330 may be offset against each other, and thus the print medium passed through the dryer 300 may have a sufficiently reduced curl and then transmitted to the post-processor 200. Accordingly, the load of the print medium may be smoothly performed in the post-processor 200.

According to the first embodiment, the inkjet image forming apparatus 100 may form an image on a single surface by using an ink or on both surfaces by using an ink.

When an image is formed on the first surface of the print medium, there may be a significant difference between a water content of the first surface in which an image is formed by an ink and a water content of the second surface in which an image is not formed. Although both surfaces of the print medium are dried by the heating device 310, as mentioned above, there may still remain a significant difference in the both surfaces of the print medium.

When there is a significant difference in the both surfaces of the print medium, a curl may be generated on opposite sides of the print medium in a width direction of the print medium, wherein the width direction is perpendicular to a moving direction of the print medium. Accordingly, the print medium may be in a state of post-processing difficulty by the post-processor 200.

According to the present disclosure, the dryer 300 may include a humidifier 340 configured to supply moisture to the second surface in which an image is not formed when an image is formed on only the first surface of the print medium.

Figure 3:
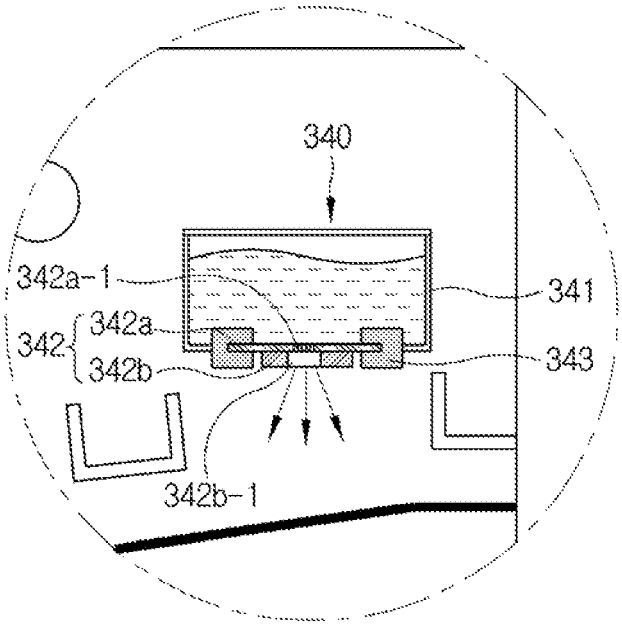
FIG. 3 is a cross-sectional view of a humidifier applied to an image forming system in accordance with a first embodiment of the present disclosure.

According to the first embodiment, the humidifier 340 may include a water bucket 341 in which water is stored, an ultrasonic vibrator 342 installed on a bottom of the water bucket 341 to allow water to be vibrated and sprayed, and a gasket 343 configured to seal between the bottom of the water bucket 341 and the ultrasonic vibrator 342, as illustrated in FIG. 3

The ultrasonic vibrator 342 may be formed of metal material, and may include a vibration plate 342*a* configured to atomize water such that an upper surface of the vibration plate 342*a* makes contact with water inside of the water bucket 341, and a piezoelectric element 342*b* disposed on a lower surface of the vibration plate 342*a* to allow the vibration plate 342*a* to be vibrated by being vibrated by receiving alternating current (AC).

The vibration plate 342*a* may include a micro hole 342*a*-1 provided in the center of the vibration plate 342*a* to allow atomized water to move to the lower side through the vibration plate 342*a*, and the ultrasonic vibrator 342*b* may include a penetration hole 342*b*-1 disposed in a position corresponding to the micro holes 342*a*-1 to allow the water passed through the micro holes 342*a*-1 to be sprayed to the lower side. A diameter of the micro hole 342*a*-1 may have a significant small, e.g. approximately 5-30 μm, to transmit only atomized water.

Only when the ultrasonic vibrator 342 is operated that is the vibration plate 342*a* is vibrated by the ultrasonic vibrator 342*b* so that water is atomized, the atomized water may pass through the micro holes 342*a*-1 and the penetration hole 342*b*-1 to be transmitted to the second surface of the print medium placed in the lower side.

The humidifier 340 may be disposed on an upper side than the heating device 310 in a transport direction of the print medium, as illustrated in FIG. 2. That is, the print medium delivered from the inkjet image forming apparatus 100 may be supplied with moisture during passing through the humidifier 340 and then pass through a position in which the heating device 310 is installed.

When supplying moisture to the second surface of the print medium in which an image is formed only on the first surface, through the humidifier 340, water content of the both surfaces of the print medium may be approximately the same. In this case, although the both surfaces of the print medium are dried by the heating device 310, the water content of the both surfaces of the print medium may be maintained to be approximately the same. Accordingly, a curl of the opposite sides of the print medium in a width direction may be significantly reduced, wherein the curl may occur due to the difference of the water content in the both surfaces of the print medium.

Since the curl of the opposite sides of the print medium in a width direction is generated when an image is formed on only the first surface of the print medium, the humidifier 340 may be controlled so that the humidifier 340 is selectively operated when an image is formed on only the first surface of the print medium and an image is not formed on the second surface, and the humidifier 340 is not operated when an image is formed on both surfaces of the print medium.

Hereinafter an operation of an image forming system configured as mentioned above will be described.

By the inkjet image forming apparatus 100, an image may be formed on the first surface of the print medium by an ink sprayed from the ink cartridge 103. The print medium having the first surface in which an image is formed may be discharged from the inkjet image forming apparatus 100 and then delivered to the dryer 300.

The print medium delivered to the dryer 300 may pass through the humidifier 340. Since the humidifier 340 supplies moisture to the second surface of the print medium, water content of the first surface of the print medium in which an image is formed and water content of the second surface of the print medium in which an image is not formed may be approximately the same.

The print medium may pass through the heating device 310 that is between the lamp 311 and the blowing fan 312. A light generated by the lamp 311 and a wind generated by the blowing fan 312 may be delivered to the both surfaces of the print medium, and thus an ink in the first surface of the print medium and a moisture in the second surface of the print medium may be dried at the same time.

As mentioned above, since the both surfaces of the print medium are dried at the same time by the lamp 311 and the blowing fan 312, the water content of the both surfaces of the print medium may be maintained to be approximately the same. When the print medium is delivered to the post-processor 200, a curl may hardly occur on the opposite sides in the width direction of the print medium.

During the print medium is dried by the heating device 310, both surfaces of the print medium may be unevenly deformed.

The print medium may be delivered to the flattening device 320. The print medium may receive a heat and a pressure while passing between the heating roller 321 and the pressure roller 322 forming the flattening device 320.

The both surfaces of the print medium, which is unevenly deformed during a drying process, may be evenly flattened by a heat and a pressure by the heating roller 321 and the pressure roller 322 and thus a thickness of the print medium may be practically same as that of an original print medium.

A curl may be generated in one direction during the print medium passes between the heating roller 321 and the pressure roller 322, as mentioned above.

The print medium may sequentially pass between the main roller 331 and the auxiliary roller 332 forming the decurling device 330. Since the decurling device 330 curls the print medium in a direction, which is opposite to the direction of the curl generated during the print medium passes through the flattening device 320, that is decurling, the curl of the print medium generated by the flattening device 320 may be significantly reduced.

As mentioned above, in the dryer 300, supplying moisture, drying, flattening and decurling may be sequentially performed in the print medium in which an image is formed only the first surface.

Hereinbefore a case in which an image is formed on only the first surface of the print medium by the inkjet image forming apparatus 100 is described, but when an image is formed on both surfaces of a print medium by the inkjet image forming apparatus 100, the process may be operated as mentioned above except that the humidifier 340 is not operated. That is, in the dryer 300, supplying moisture through the humidifier 340 may be not performed but drying, flattening and decurling of the print medium may be sequentially performed.

According to the first embodiment, the dryer 300 may include 340, but is not limited thereto. The dryer 300 may be configured to not include the dryer 300.

Figure 4:
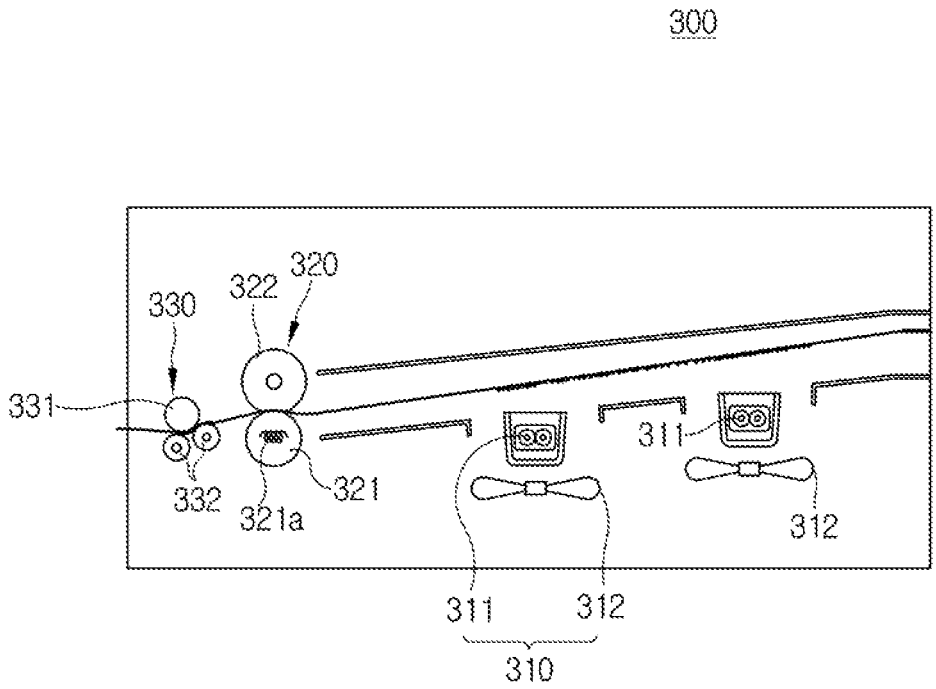
FIG. 4 is a schematic view of a dryer for an inkjet image forming apparatus applied to an image forming system in accordance with a second embodiment of the present disclosure.

According to the first embodiment, the lamp 311 and the blowing fan 312 may be provided on both of an upper side and a lower side of the print medium to dry both surfaces of the print medium, but it may be to dry the second surface of the print medium to which moisture is supplied via the humidifier 340 or for when an image is formed on both surfaces of the print medium. Therefore, when there is not duplex function or when the dryer 300 does not include the humidifier 340, as a second embodiment of the present disclosure illustrated in FIG. 4, the lamp 311 and the blowing fan 312 may be provided to face only the first surface of the print medium in which an image is formed.

According to the first embodiment, the heating device 310 may include the lamp 311 and the blowing fan 312, but is not limited thereto. Therefore, the heating device 310 may be configured to include any one of the lamp 311 and the blowing fan 312.

Figure 5:
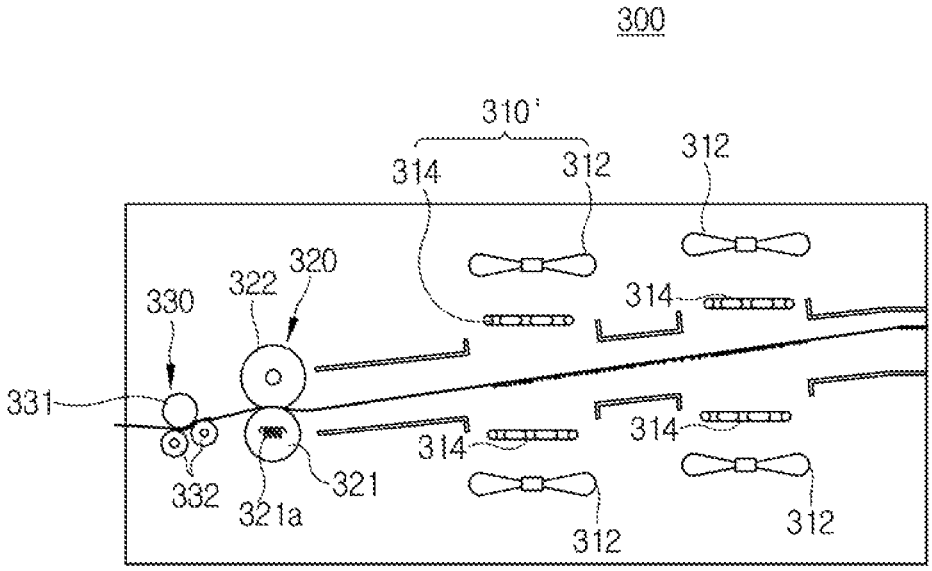
FIG. 5 is a schematic view of a dryer for an inkjet image forming apparatus applied to an image forming system in accordance with a third embodiment of the present disclosure.

According to a third embodiment of the present disclosure as illustrated in FIG. 5, a heating device 310' may include a heater formed of heating wire 314 instead of the lamp 311. In this case, hot-air generated by the heating wire 314 and the blowing fan 312 may be supplied to a surface of the print medium so that an ink on the print medium is dried by the hot-air.

According to the first embodiment, the dryer 300 may be installed between the inkjet image forming apparatus 100 and the post-processor 200 to be used to perform post-processing of the print medium, but is not limited. Therefore, the dryer 300 may be used to dry and flatten the print medium discharged from the inkjet image forming apparatus 100 in a state in which the post-processor 200 is not connected.

According to the first embodiment, the dryer 300 may be detachably installed between the inkjet image forming apparatus 100 and the post-processor 200, but is not limited. The dryer 300 may be included in the inkjet image forming apparatus 100 or the post-processor 200.

Figure 6:
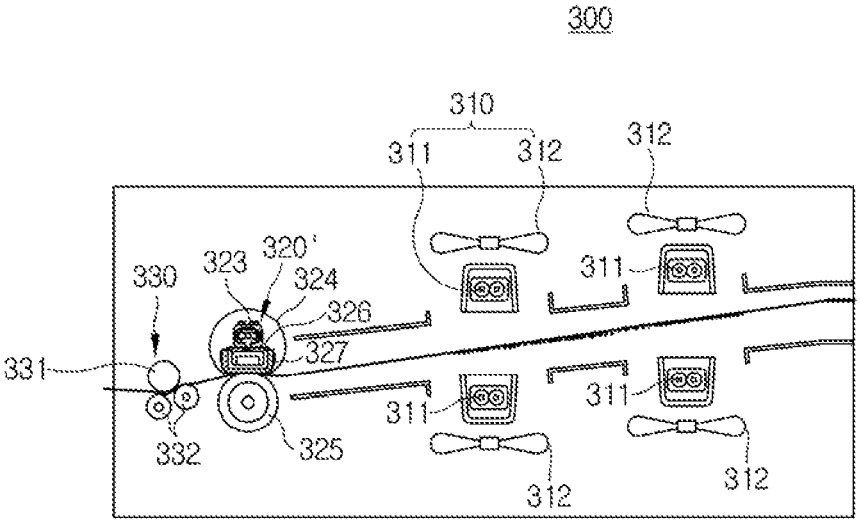
FIG. 6 is a schematic view of a dryer for an inkjet image forming apparatus applied to an image forming system in accordance with a fourth embodiment of the present disclosure.

According to the first embodiment, the flattening device 320 may include the heating roller 321 and the pressure roller 322, but is not limited. According to a fourth embodiment of the present disclosure as illustrated in FIG. 6, a flattening device 320' may include a heating belt 324 provided with a heater 323 formed by a lamp and disposed inside of the heating belt 324, a pressure roller 325 disposed to make contact with an outer surface of the heating belt 324 to press the print medium toward the heating belt 324, a reflector 326 disposed inside of the heating belt 324, particularly between the heater 323 and the pressure roller 325 so that a heat generated by the heater 323 is reflected toward the inside of the heating belt 324, and a guide member 327 disposed in the inside of the heating belt 324 to be opposite to the pressure roller 325 in a state in which the heating belt 324 is interposed, so as to guide a movement of the heating belt 324. In this case, a surface of the guide member 327 that is opposite to the pressure roller 325 (a lower surface of the guide member 327 in FIG. 6) may be formed to be flat and thus the pressure roller 325 may make contact with a portion of the heating belt 324 that is deformed to be flat to correspond to the lower surface of the guide member 327. Accordingly, the generation of the curl of the print medium may be reduced by employing the flattening device 320' provided with the heating belt 324.

According to the first embodiment, the dryer 300 may include both of the flattening device 320' and the decurling device 330, as mentioned above, the dryer may be configured to not include the decurling device since the curl may be less generated in the flattening device 320' provided with the heating belt 324.

Figure 7:
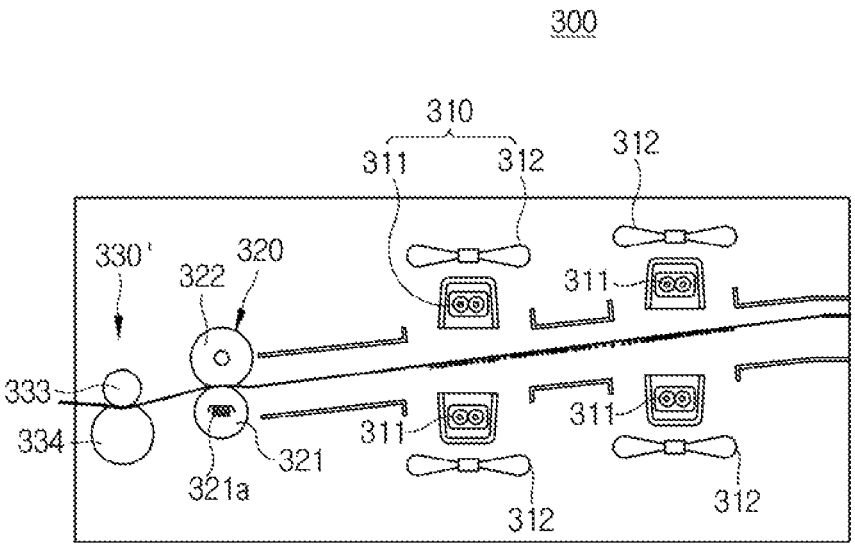
FIG. 7 is a schematic view of a dryer for an inkjet image forming apparatus applied to an image forming system in accordance with a fifth embodiment of the present disclosure.

According to the first embodiment, the decurling device 330 may include the main roller 331 and a pair of the auxiliary roller 332, but is not limited thereto. According to a fifth embodiment of the present disclosure as illustrated in FIG. 7, a decurling device 330' may include a shaft 333 formed of metal to have a stick shape, and an elastic roller 334 having an outer circumference formed of elastically deformable material to press a print medium toward an outer circumference of the shaft 333.

Figure 8:
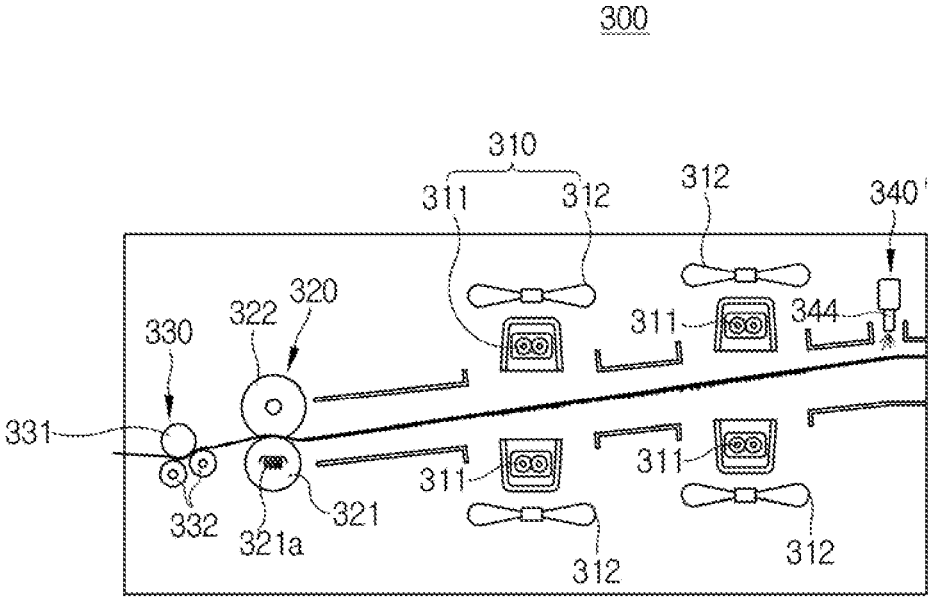
FIG. 8 is a schematic view of a dryer for an inkjet image forming apparatus applied to an image forming system in accordance with a sixth embodiment of the present disclosure.

According to the first embodiment, the humidifier may include the water bucket 341 and the ultrasonic vibrator 342, but is not limited thereto. According to a sixth embodiment of the present disclosure as illustrated in FIG. 8, a humidifier 340' may include a nozzle 344 configured to spray water directly to the second surface of the print medium. In addition, the humidifier may include a roller and a sponge disposed to make contact with the print medium so that moisture is allowed to be sprayed to the second surface of the print medium.

As is apparent from the above description, according to the proposed dryer for an inkjet image forming apparatus and imaging forming system having the same, an ink on a print medium discharged from the inkjet image forming apparatus may be dried and thus drying of the ink may be performed in a short time.

According to the proposed dryer for an inkjet image forming apparatus and imaging forming system having the same, a printed portion may be flattened by a flattening device and thus a height of loaded pint media may be reduced when the print media is loaded.

According to the proposed dryer for an inkjet image forming apparatus and imaging forming system having the same, through a decurling device a curing may be performed on the print medium, in which a curl is generated in a direction in a process of passing through a flattening device, in an opposite direction, that is decurling, and thus the curl in the print medium may be significantly reduced.

According to the proposed dryer for an inkjet image forming apparatus, the dryer may include a humidifier configured to supply moisture to a printed surface and an opposite surface to the printed surface so that a curl, which is generated in opposite sides in a width direction that is perpendicular to a moving direction of the print medium, may be reduced.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A dryer for an inkjet image forming apparatus, comprising:

a heating device detachably installed in the inkjet image forming apparatus, the heating device to:

receive a print medium, onto which an inkjet image is formed by the inkjet image forming apparatus, and dry the received print medium by applying heat from a first direction to dry a first surface of the print medium and by applying heat from a second direction to dry a second surface of the print medium that is opposite to the first surface;

a flattening device to apply heat to the print medium to flatten the print medium that is dried by the heating device; and a decurling device to curl the print medium that is flattened by the flattening device, in a decurling direction opposite to a direction of a curl of the print medium that occurs in a process of passing through the flattening device.

2. The dryer for the inkjet image forming apparatus of claim 1, wherein the heating device includes a lamp to irradiate a light to a surface of the print medium to dry the received print medium.

3. The dryer for the inkjet image forming apparatus of claim 1 wherein the heating device comprises a heater to generate the heat to be applied by the heating device to dry the received print medium.

4. The dryer for the inkjet image forming apparatus of claim 1, wherein the heating device comprises a blowing fan to blow air to a surface of the print medium to dry the received print medium.

5. The dryer for the inkjet image forming apparatus of claim 1, wherein the flattening device comprises a heating roller to apply the heat to be applied by the flattening device to the print medium, and a pressure roller to press the received print medium to which the heat to be applied by the flattening device is applied by the heating roller.

6. The dryer for the inkjet image forming apparatus of claim 1, further comprising:

a humidifier to supply moisture to an opposite surface of the received print medium opposite to an image-formed surface of the received print medium onto which the inkjet image is formed by the inkjet image forming apparatus.

7. The dryer for the inkjet image forming apparatus of claim 6, wherein the humidifier comprises:

a water bucket to store water; and an ultrasonic vibrator installed in a lower surface of the water bucket to supply moisture to the opposite surface of the received print medium using the stored water in the water bucket.

8. The dryer for the inkjet image forming apparatus of claim 7, wherein the ultrasonic vibrator comprises:

a vibration plate disposed to allow an upper surface thereof to be in contact with the water stored in the water bucket; and a piezoelectric element disposed on a lower surface of the vibration plate to allow the vibration plate to be vibrated to supply moisture to the opposite surface of the received print medium.

9. The dryer for the inkjet image forming apparatus of claim 8, wherein the vibration plate comprises:

micro holes having a diameter allowing atomized water to pass through; and the piezoelectric element comprises a penetration hole disposed in a position corresponding to the micro holes.

10. The dryer for the inkjet image forming apparatus of claim 6 wherein the humidifier comprises a nozzle to spray water to the opposite surface of the received print medium, to supply moisture to the opposite surface of the print medium.

11. A dryer for an inkjet image forming apparatus, comprising:

a heating device detachably installed in the inkjet image forming apparatus, the heating device to:

receive a print medium, onto which an inkjet image is formed by the inkjet image forming apparatus, and dry the received print medium;

a flattening device to heat the printing medium to flatten the print medium that is dried by the heating device, wherein the flattening device comprises:

a heating belt provided with a heater disposed inside of the heating belt, a pressure roller to press the received print medium while rolling the received print medium toward an outer surface of the heating belt, a reflector disposed inside of the heating belt between the heater and the pressure roller, and a guide member disposed opposite to the pressure roller in a state in which the heating belt is interposed; and a decurling device to curl the print medium that is flattened by the flattening device, in a decurling direction opposite to a direction of a curl of the print medium that occurs in a process of passing through the flattening device.

12. The dryer for the inkjet image forming apparatus of claim 1, wherein the decurling device comprises:

a main roller; and a pair of auxiliary roller having a diameter smaller than that of the main roller and disposed to contact side by side with an outer circumference surface of the main roller.

13. The dryer for the inkjet image forming apparatus of claim 1, wherein the decurling device comprises:

a shaft having a stick shape; and an elastic roller having an outer circumference formed of elastically deformable material to press the print medium toward an outer circumference of the shaft.

14. An image forming system, comprising:

an inkjet image forming apparatus to output a print medium;

a post-processor to:

receive the output print medium from the inkjet image forming apparatus, and perform post-processing on the received a print medium; and a dryer, disposed between the inkjet image forming apparatus and the post-processor, to dry the output print medium while the output print medium is delivered from the inkjet image forming apparatus to the post-processor, the dryer including:

a heating device detachably installed in the inkjet image forming apparatus, the heating device to:

receive a print medium, onto which an inkjet image is formed by the inkjet image forming apparatus, and dry the received print medium by applying heat from a first direction to dry a first surface of the print medium and by applying heat from a second direction to dry a second surface of the print medium that is opposite to the first surface, a flattening device to apply heat to the print medium to flatten the print medium that is dried by the heating device, and a decurling device to curl the print medium that is flattened by the flattening device, in a decurling direction opposite to a direction of a curl of the print medium that occurs in a process of passing through the flattening device.

15. The image forming system of claim 14, wherein the dryer is detachably installed between the inkjet image forming apparatus and the post-processor.

16. The image forming system of claim 14, wherein the inkjet image forming apparatus comprises the dryer.

17. The image forming system of claim 14, wherein the post-processor comprises the dryer.

* * * * *